US010781073B2

(12) United States Patent
Bambauer

(10) Patent No.: US 10,781,073 B2
(45) Date of Patent: Sep. 22, 2020

(54) HYDRAULICALLY DRIVEN AGRICULTURAL HOSE REEL

(71) Applicant: Bambauer Equipment LLC, New Knoxville, OH (US)

(72) Inventor: Scott A. Bambauer, New Knoxville, OH (US)

(73) Assignee: Bambauer Equipment LLC, New Knoxville, OH (US)

( * ) Notice: Subject to any disclaimer, the term of this patent is extended or adjusted under 35 U.S.C. 154(b) by 160 days.

(21) Appl. No.: 15/728,075

(22) Filed: Oct. 9, 2017

(65) Prior Publication Data

US 2018/0099837 A1 Apr. 12, 2018

Related U.S. Application Data

(60) Provisional application No. 62/405,629, filed on Oct. 7, 2016.

(51) Int. Cl.
*B65H 75/44* (2006.01)
*B65H 75/42* (2006.01)

(52) U.S. Cl.
CPC ..... *B65H 75/4489* (2013.01); *B65H 75/425* (2013.01); *B65H 75/4407* (2013.01); *B65H 2701/33* (2013.01); *Y10T 137/6932* (2015.04); *Y10T 137/6954* (2015.04)

(58) Field of Classification Search
CPC ..... B65H 75/4489; B65H 75/425; B65H 75/241; B65H 75/4407; B65H 2701/33; Y10T 137/6932; Y10T 137/6954
USPC ..... 137/355.12, 355.16–355.28
See application file for complete search history.

(56) References Cited

U.S. PATENT DOCUMENTS 3,628,728 A 12/1971 Polutnik et al.
3,739,985 A * 6/1973 Odom ..... A01G 25/095 239/172
3,941,324 A 3/1976 Green
4,306,682 A * 12/1981 Toussaint ..... A01G 25/095 137/355.27
4,664,331 A * 5/1987 Halbrook ..... B65H 49/32 191/12.2 A
4,830,283 A * 5/1989 Johnson ..... A01G 25/095 137/355.2
5,201,406 A * 4/1993 Kellis ..... B65H 75/425 198/812
6,527,215 B1 * 3/2003 Cain ..... B65H 75/14 242/394
8,118,113 B2 * 2/2012 Wrede ..... E21B 7/022 173/148
9,206,658 B1 * 12/2015 Dion ..... E21B 19/22
2007/0119997 A1 * 5/2007 Boon ..... B65H 75/425 242/159

(Continued)

*Primary Examiner* — Kevin F Murphy
*Assistant Examiner* — Jonathan J Waddy
(74) *Attorney, Agent, or Firm* — Dinsmore & Shohl, LLP

(57) ABSTRACT

Embodiments of a hydraulically driven agricultural hose reel comprise a spool, a frame, the hose reel having a front end, back end, drive side, and a free side. The hose reel includes a hydraulic motor system powered by a hydraulic pump, which turns the spool though a transmission assembly. The hydraulic motor system comprises a manifold that selectively sets the hose reel to a series operating configuration, parallel operating configuration, or a free wheel operating configuration.

18 Claims, 13 Drawing Sheets

(56) References Cited

U.S. PATENT DOCUMENTS

| | | | | |
|---|---|---|---|---|
| 2010/0314132 | A1* | 12/2010 | Coles | E21B 19/22<br>166/384 |
| 2015/0083843 | A1* | 3/2015 | Rekieta | B65H 75/38<br>242/394 |
| 2015/0122350 | A1* | 5/2015 | Morgan | B65H 75/446<br>137/355.26 |

* cited by examiner

HYDRAULICALLY DRIVEN AGRICULTURAL HOSE REEL

CROSS-REFERENCE TO RELATED APPLICATIONS

This application claims the benefit of U.S. Provisional Application No. 62/405,629 filed Oct. 7, 2016.

TECHNICAL FIELD

The present disclosure is generally related to hose reels, and is specifically directed to hydraulically driven commercial hose reel systems.

BACKGROUND

There are a variety of agricultural hose reel systems in use today. One variety is a hydraulically driven hose reel that is removably mounted to a tractor or transporter by a hitch, or a 3 point hitch. Other varieties of hose reels include those connected to a wheeled carriage and a tow hitch, and hose reels powered by a direct drive. Hose reels are primarily used in the agricultural markets such as fertilizer, dairy waste, hog waste, and irrigation, and other fluid transfer, as well as firefighting and down-hole water supply for fracking and oil extraction. Hose reels are used to retrieve and deploy hoses from about one eighth of a mile to eight miles from a spool as the hose reel is pushed or pulled by a tractor or other means, wherein the hoses general have a diameter ranging from about 1 inch to about 14 inches. The removably mounted hose reel may be shuttled when detached, whereas wheeled versions may have to be towed when changing job sites. Hydraulically driven hose reels have fewer moving parts than direct drive versions and allow for simpler connection and disconnections from the tractor, as well as allowing for powering of hose reel auxiliary systems. Traditional hydraulically driven hose reels have either one hydraulic motor driving the spool, or two hydraulic motors driving the spool, with one motor on each opposing end of the spool, resulting in either limited power and flexibility or additional parts and drive systems. Currently available hydraulically driven hose reels have been limited to these configurations, as adding any more motors to increase speed or torque is either cumbersome or impossible.

Although the foregoing prior art hose reels have been generally adequate for their intended purposes, they have not been satisfactory in all aspects.

SUMMARY

The present invention addresses a need that has arisen for a more versatile agricultural hose reel which provides increased flexibility in spool turning variation, reduces the number of parts and complexity, and improves the ability to transport the hose reel between work locations.

According to one embodiment, a hydraulically driven agricultural hose reel is disclosed. The hose reel comprises a front end, a back end, a drive side, and a free side, and a spool journaled to a frame. The spool is configured to deploy and retrieve a hose. A transmission assembly is mounted to the frame and configured to rotate the spool via a hydraulic motor system hydraulically powered through a hydraulic manifold. The hydraulic motor system may comprise one or more motors located on the drive side of the hose reel, and the hydraulic manifold is configured to set selectively the hydraulic motor system in one of series, parallel, and free wheel operating modes.

According to another embodiment, a method of loading a hose reel from a tractor to a loading surface is disclosed. The method may comprise positioning a hose reel mounted to a tractor by a hose reel hitch, a tractor hitch, and a securing means above the loading surface, and lowering one or more hydraulically operated support legs located on a back end of the hose reel, each configured to partially support the hose reel on the loading surface. The method may further comprise removing pressure from the hose reel hitch and the tractor hitch caused by the hose reel weight and releasing the securing means, wherein the hose reel is at an angle which allows the hose reel hitch to disengage from the tractor hitch, and partially lowering one or more support legs on a front end and the back end of the hose reel, wherein the one or more support legs fully support the hose reel. The method may further comprise moving the tractor hitch out of the path of the hose reel hitch.

These and additional features provided by the embodiments of the present invention will be more fully understood in view of the following detailed description, in conjunction with the drawings.

BRIEF DESCRIPTION OF THE DRAWINGS

The following detailed description of specific embodiments of the present invention can be best understood when read in conjunction with the following drawings, where like structure is indicated with like reference numerals and in which.

Figure 1:
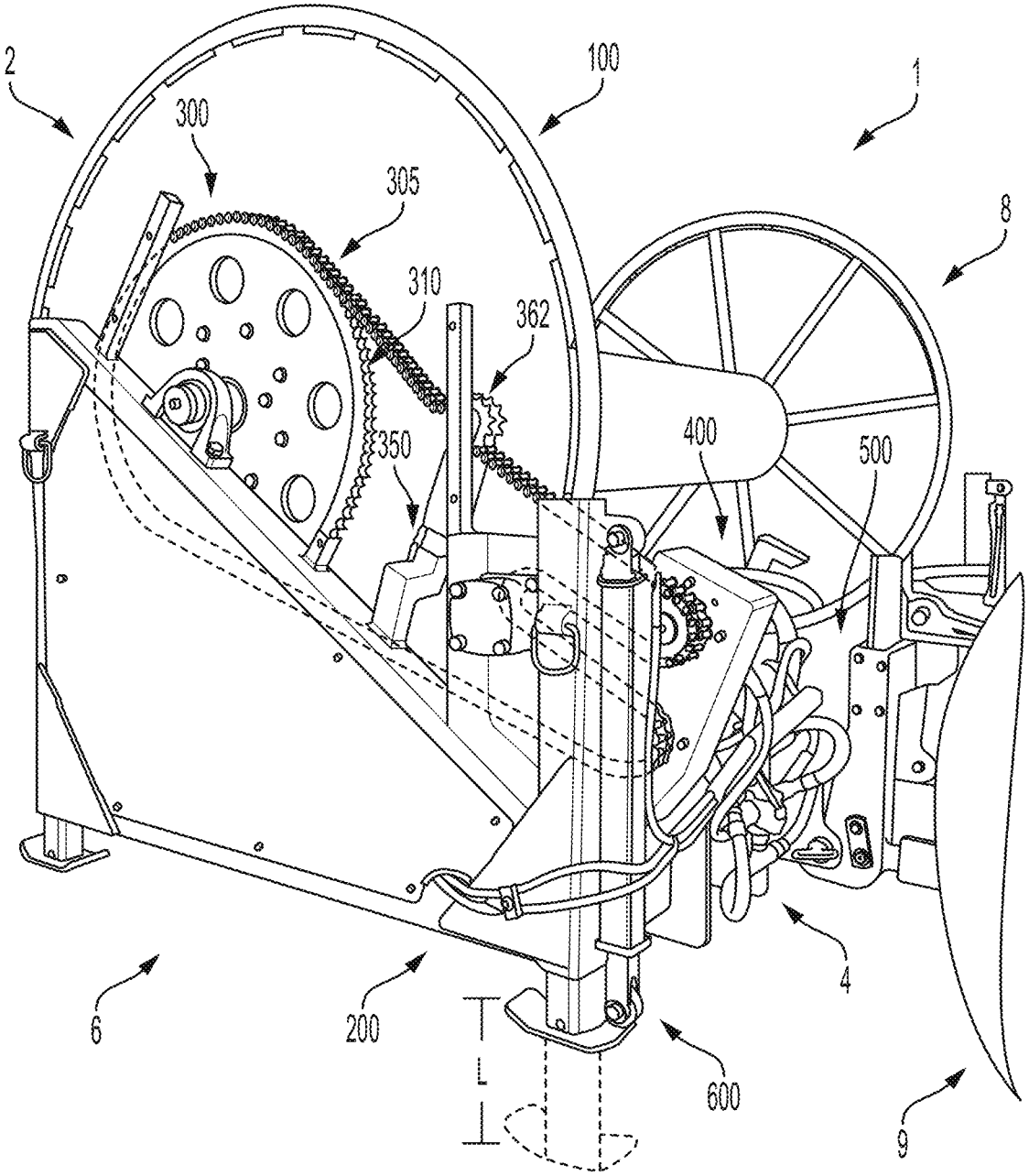
FIG. 1 is a perspective view depicting a hydraulically driven agricultural hose reel system according to one or more embodiments of the present invention.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

Referring to FIG. 1, a hydraulically powered agricultural hose reel 1 is shown. The hose reel 1 comprises a hose reel spool 100 journaled to a frame 200 for retaining a hose, a transmission assembly 300 mechanically linked to the spool 100, a hydraulic motor system 400 which drives the spool 100, and a hydraulic manifold assembly 500 to power the hydraulic motor system 400. As used herein, the front end 2 of the hose reel 1 is the end furthest away from the tractor 9 when mounted thereto. Conversely, the back end 4 of the hose reel 1 is the end closest to the tractor 9 when mounted thereto. The drive side 6 of the hose reel 1 is the side on which the transmission assembly 300 and motor system 400 are located. The free side 8 of the hose reel 1 is the side on which no transmission assembly 300 or motor system 400 is located. Although the drive side 6 is shown to be a particular side of the hose reel 1 in FIG. 1, it is contemplated that the drive side 6 and the free side 8 could be swapped in some embodiments.

In further embodiments, the hose reel 1 may comprise a support assembly 600 to aid in moving, supporting, and stabilizing the hose reel 1 when it is not mounted to a tractor 9. The support assembly may also assist in attaching and detaching from the tractor 9, and loading or unloading the hose reel 1 from storage or transporting devices, such as a tow trailer such as a step deck trailer. It is contemplated that the hose reel 1 may be mounted to any power driven vehicle capable of operating the hose reel 1, such as a tractor 9. Various embodiments for the support assembly 600 are contemplated, including the retractable and extendable system shown in FIG. 1, as well as wheels, manually operated legs, and stationary legs.

Hose reels 1 generally have spools 100 up to about 10 feet in diameter. The primary limitation to the size of the hose reel 1 is restriction widths for equipment that can be transported on road systems. Therefore, it is important to be able to design the hose reels so that as many as possible are capable of being transported over the road at once on a single truck or tow trailer. Therefore, having a hose reel 1 that is approximately 102 inches wide and long may be optimal. Additionally, being able to change the orientation of the spool 100 while on a truck or tow trailer, such as rotating the spool 100, may be effective in increasing the mobility of the hose reel 1, wherein hose reels 1 of longer length and/or larger diameter than those mentioned above may be conventionally provided.

Figure 2:
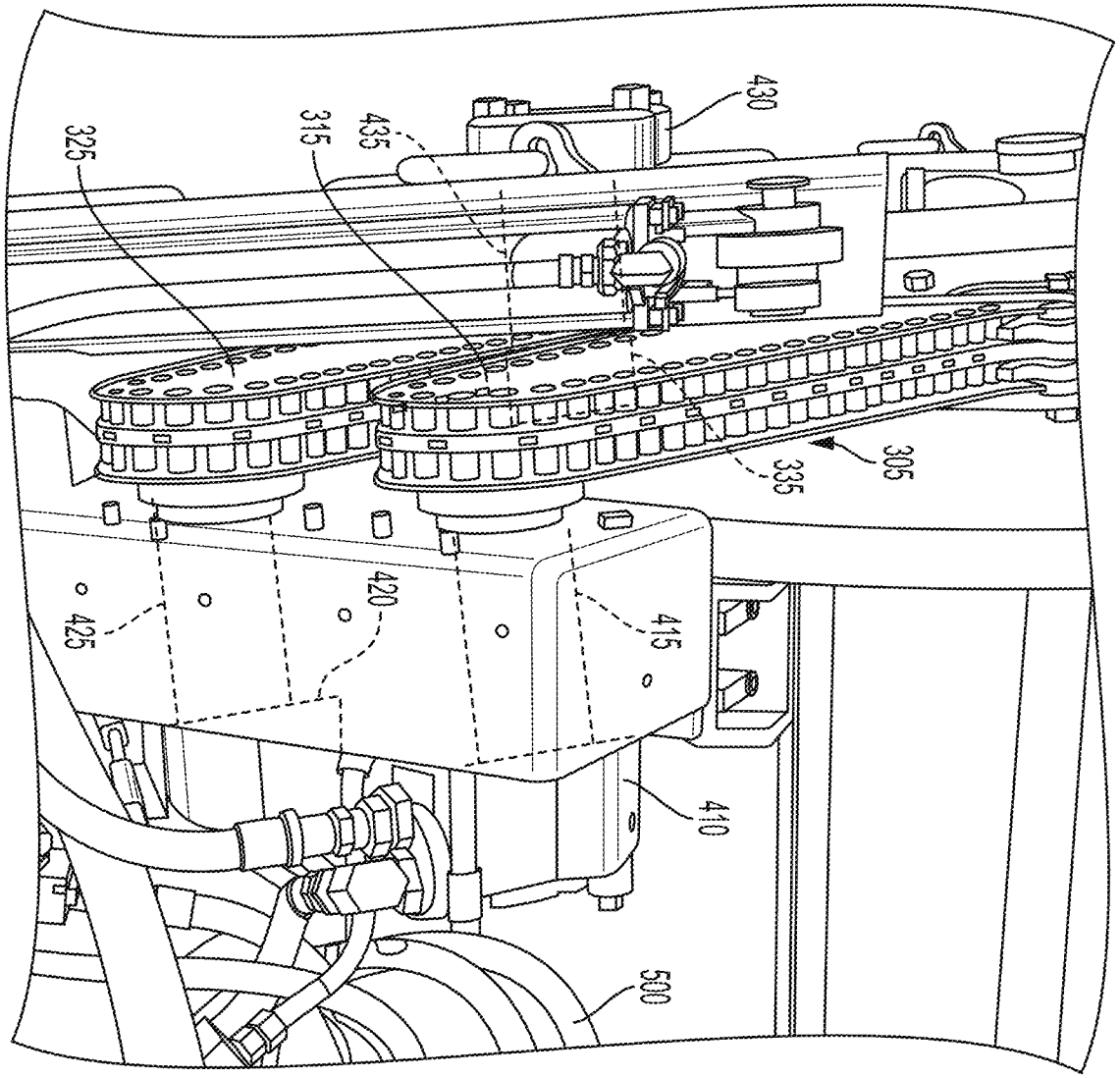
FIG. 2 is a perspective view depicting the drive train of the hose reel according to one or more embodiments of the present invention.

Referring to FIGS. 1 and 2, various elements of the transmission assembly 300 and the hydraulic motor system 400 are shown. In the embodiment shown in the FIG. 2, a first hydraulic motor 410, a second hydraulic motor 420, and a third hydraulic motor 430 are utilized to drive the spool 100 of the hose reel 1. In one or more embodiments of the present invention, the hydraulic motor system 400 will have only two motors used to drive the spool 100 located on the drive side 6 of the hose reel 1. In other specific embodiments three motors will be used. It is further contemplated that any number of motors and configurations may be utilized by the present invention to drive the spool 100. The first hydraulic motor 410 is coupled to the transmission assembly 300 by the first driveshaft 415. Likewise, the second hydraulic motor 420 is coupled to the transmission assembly 300 by the second driveshaft 425, and the third hydraulic motor 430 is coupled to the transmission assembly 300 by the third driveshaft 435.

As stated above, previously available hose reels were operated with only one hydraulic motor, or with one hydraulic motor on each side the spool. However, up until the embodiments of the present invention, having two or more hydraulic motors on the drive side 6 of the hose reel 1 has not been achieved in an effective manner. The use of two or more hydraulic motors on one side of the spool 100 reduces the number of parts in the transmission assembly 300 and the hydraulic motor system 400, as they can share one transmission assembly 300. Having motors on both ends of the spool 100 also requires having an additional transmission assembly 300, increasing build, operating, and maintenance costs. Additionally, utilizing two more hydraulic motors coupled to the same transmission assembly 300 allows for improved control and variation of the speed and torque available to the spool 100.

Still referring to FIGS. 1 and 2, the first driveshaft 415, second driveshaft 425, and third driveshaft are coupled to the first drive sprocket 315, second drive sprocket 325, and third drive sprocket 335, respectively, in order to power the spool drive means 305. The spool drive means 305 turns the spool sprocket 310, rotating the spool 100 to retrieve and deploy a hose. The sprockets are contemplated to be of any type of transmission gearing known in the art that may be suitable for driving the spool 100. Additionally, the spool drive means 305 may be any power transferring means suitable for the application that is known in the art, such as a drive chain, drive belt or drive shaft. In certain embodiments, the hydraulic motor system 400 receives power from a pump located on the tractor 9, and is transferred to the two or more motors through the hydraulic manifold 500. It is also contemplated that the tractor 9 or other power source may provide a direct drive to a hydraulic pump located on the hose reel 1, which in turn activates the hydraulic motors and other auxiliary hydraulic systems.

Figure 3:
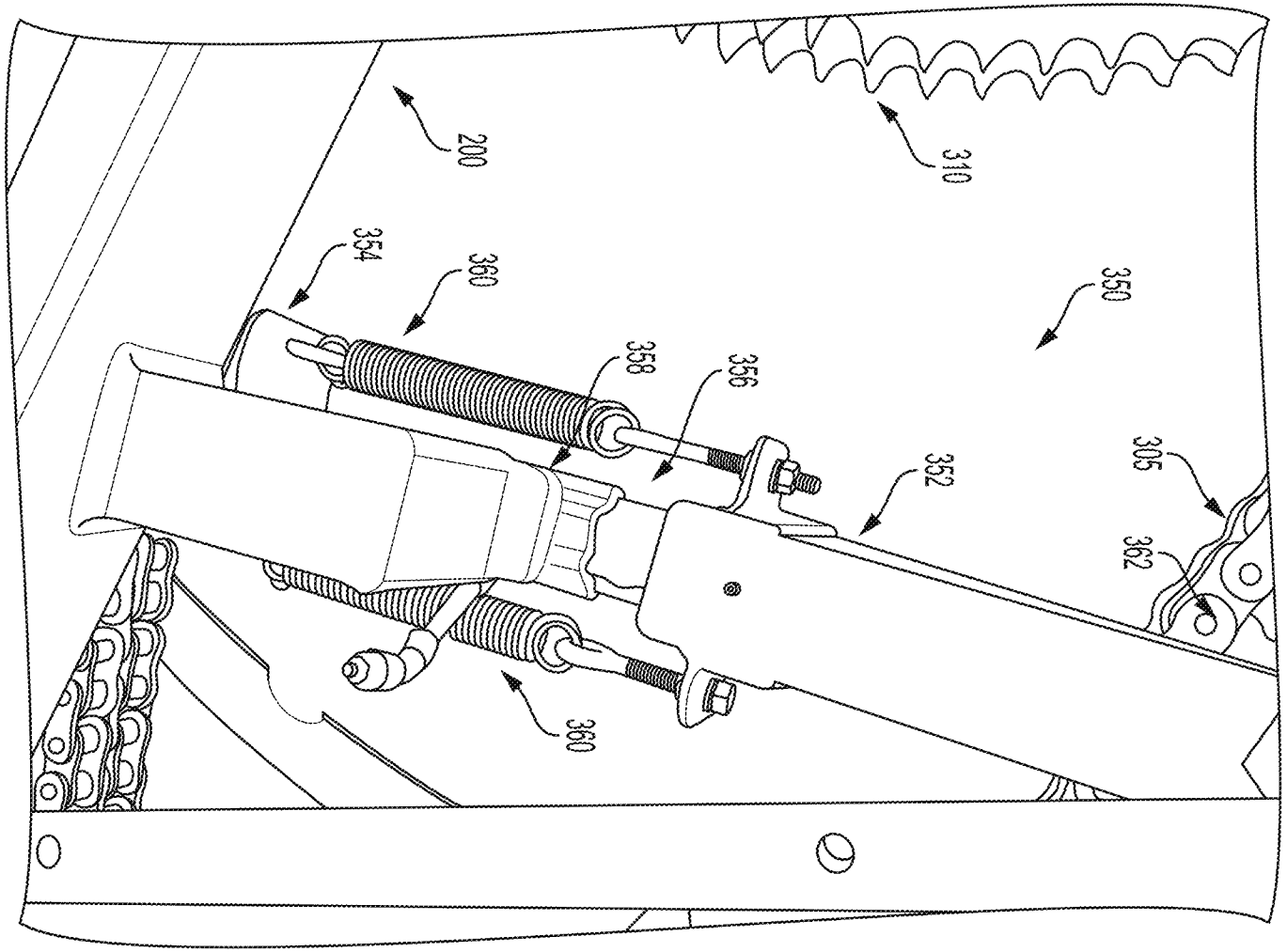
FIG. 3 is a perspective view of cot of the chain tensioning system of the hose reel according to one or more embodiments of the present invention.

Referring now to FIGS. 1 and 3, a tensioner 350 is shown restricting the travel of the spool drive means 305. With two or more hydraulic motors driving the spool drive means 305, each with an individual drive sprocket, the tensioner 350 is utilized to automatically adjust the tension in the spool drive means 305 to both prevent the spool drive means 305 from loosening from the spool sprocket 310 and becoming dislodged, and ensuring that minimal energy is lost due poor power transmission to the spool sprocket 310. The tensioner 350 shown in FIG. 3 has a first chain restraining arm 352 and a second chain restraining arm 354, which are coupled by tensioner springs 360. In one or more embodiments, the tensioner springs 360 may be any means able to provide the necessary tension know in the art. The tensioner springs 360 may be adjusted to change the amount of tension they provide during operation. The first chain restraining arm 352 and the second chain restraining arm 354 travel along a tensioner shaft 356, which allows the restraining arms to slide freely according to the pressure applied by the tensioner springs 360 and make the tension adjustments to the spool drive means 305. The first chain restraining arm 352 is coupled to the spool drive means 305 by the first tensioner sprocket 362 and the second chain restraining arm 354 is coupled to the spool drive means 305 by the first tensioner sprocket (not shown), allowing the tensioner to apply pressure and allow the spool drive means 305 to move freely. The tensioner 350 is mounted to the frame 200 by a tensioner support bracket 358. While it is shown that the first chain restraining arm 352 and a second chain restraining arm 354 interact with the spool drive means 305 along a shared axis and substantially equidistant from the tensioner 350 center, it is contemplated that many configurations of the tensioner 350 exist and could be utilized in the present invention. It is also contemplated that one or more embodiments of the invention may have additional tensioners 350.

Figure 4:
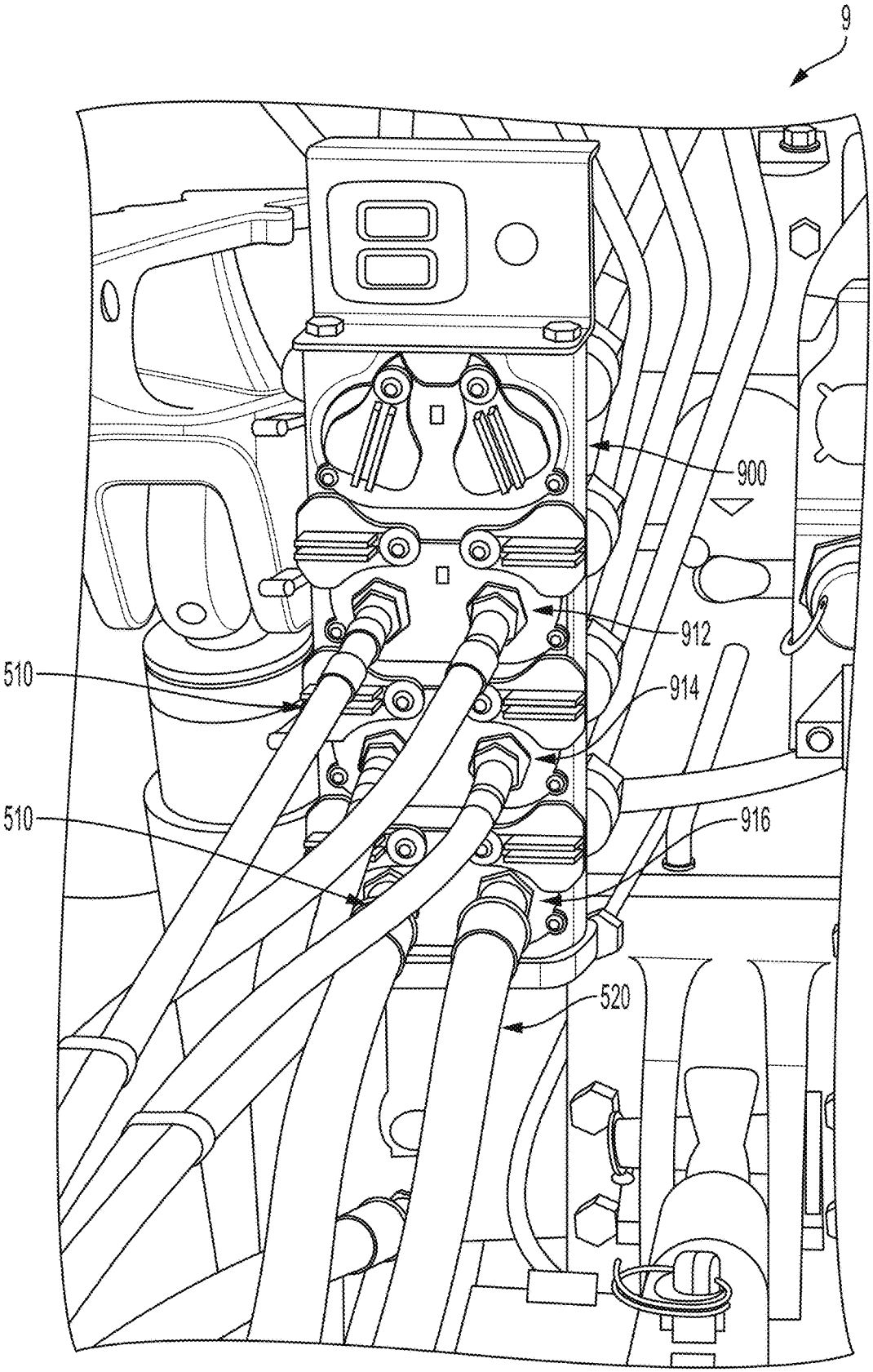
FIG. 4 is a perspective view depicting the tractor-side hydraulic hook-ups and hydraulic hoses which power systems on the hose reel according to one or more embodiments of the present invention.

Referring now to FIGS. 1 and 4, the power source hydraulic hook-ups 900 of a tractor 9 are shown. Alternatively, another powered drive vehicle or external power source may be used to provide the hydraulic hook-ups to energize the hydraulic motors of the hose reel 1. The power source hydraulic hook-ups 900 may comprise a first hydraulic leg hook-up 912, a second hydraulic leg hook-up 914, and a hydraulic motor assembly hook-up 916. As is shown, each of the hydraulic leg hook-ups may be coupled to one or more hydraulic piston hoses 510 which transfer the hydraulic fluid to the hydraulic manifold 500 and/or the support assembly 600. Additionally, the hydraulic motor assembly hook-up 916 may be coupled to one or more hydraulic motor assembly hoses 520 which transfer the hydraulic fluid to the hydraulic manifold 500 and/or the hydraulic motor system 400.

Figure 5A:
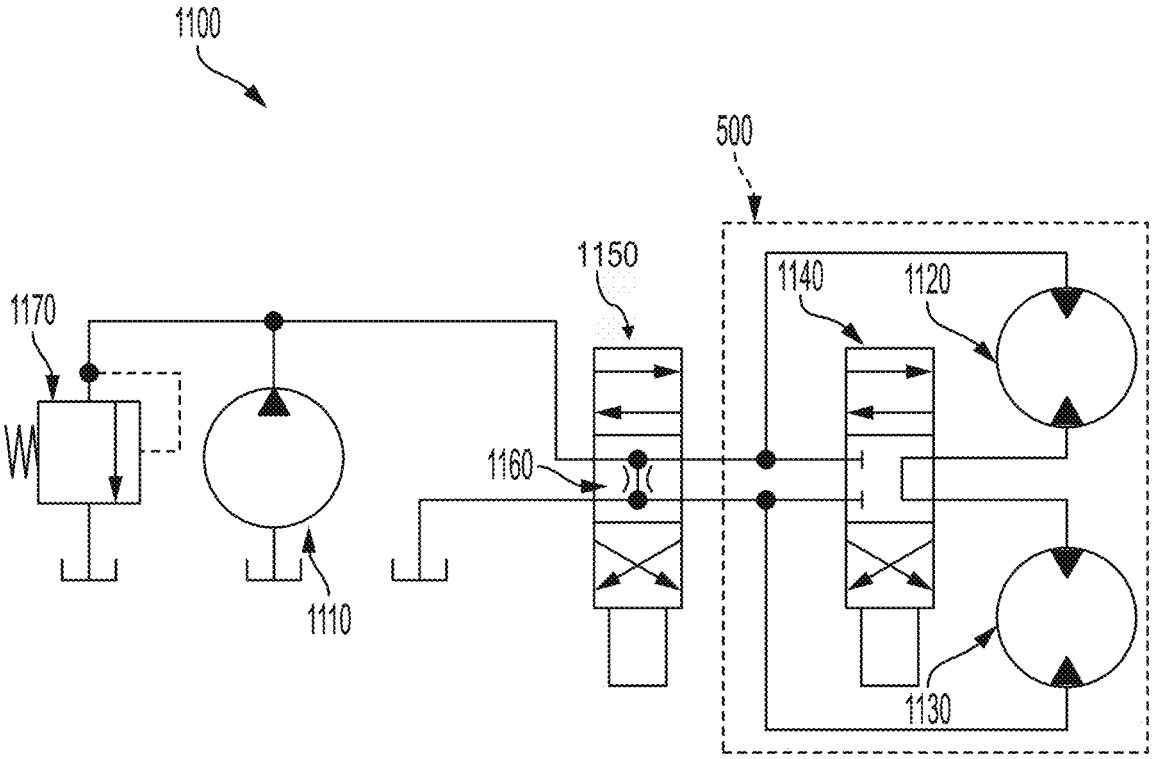
FIG. 5A is a circuit diagram depicting the hydraulic system driving the spool of the hose reel according to one or more embodiments of the present invention.

Referring to FIG. 5A, a circuit diagram of a bi-motor hydraulic system 1100 capable of driving the spool 100 of the hose reel 1 is shown. The hydraulic pump 1110 pushes the hydraulic fluid through the hydraulic manifold 500 to the first bi-motor 1120 and the second bi-motor 1130. The directional valve 1140 allows the spool 100 to be turned in either the forward or reverse direction. This bi-motor hydraulic system 1100 is configured to run selectively the motors in one of a series, parallel, and free wheel operating modes though the use of mode valve 1150, which sets the selected mode. While in a series operating mode configuration, the hydraulic fluid is first sent to either first bi-motor 1120 or second bi-motor 1130, and then the remaining motor. This results in one motor receiving more of the pressure, and increases the speed that the spool 100 turns but lowering the torque in comparison to the parallel mode. While in a parallel operating mode configuration, the hydraulic fluid is sent to both of the motors equally, resulting in an increase in torque and decrease in speed of the system in comparison to the series operating mode configuration. With two motors in parallel, the torque is doubled from that of one motor, and the speed is reduced to half. It is to be appreciated that other hose reels have been capable of turning the motors in the reverse and forward direction, but generally speed and torque changes could only be made by adjusting the hydraulic fluid pressure in the pump system. While in the free wheel operating mode configuration, no hydraulic fluid is forced through the motors, however they are free to turn. This allows the spool 100 to turn freely with only the resistance provided by the transmission assembly 300, the motors, the weight of the spool 100, and other nominal factors to prevent the spool 100 from turning. This resistance is expected to be about 40 pounds of pressure, but may be up to about 80 pounds and down to about 20 pounds, depending on the operating mode configuration of the hose reel 1. This is generally enough resistance to prevent the hose from unreeling from the spool 100 without external interference.

Having the above mentioned operating modes available and easily selectable is advantageous as conditions change while retrieving and deploying a hose. For instance, when cornering, it is contemplated that the speed of the spool 100 may need to be increased to ensure the hose is laid uniformly or wound quickly enough. Conversely, on long straight tracks, the hose can be laid in the free wheel operating mode configuration. The optional flow restrictor 1160 is capable of limiting the flow of hydraulic fluid to the motors, allowing for the resistance the spool 100 has to overcome to turn during the free wheel operating mode configuration. Altering the resistance through the flow restrictor 1160 may be useful for increasing and decreasing the rate a hose deploys from the hose reel 1. It is contemplated the flow restrictor 1160 may be fixed or adjustable. Additionally, the system relief valve 1170 protects the system from excess pressure.

Figure 5B:
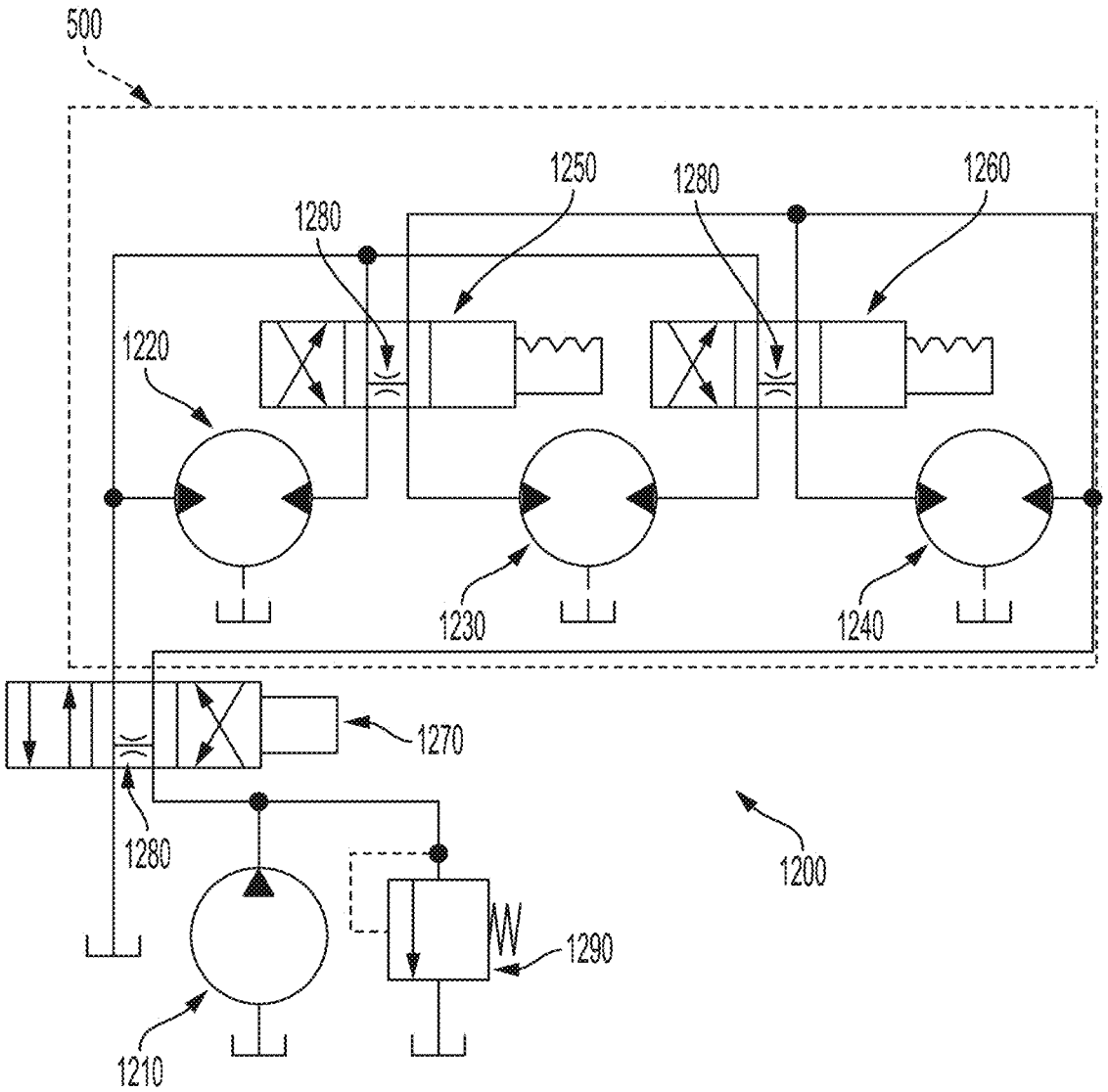
FIG. 5B is a circuit diagram depicting the hydraulic system driving the spool of the hose reel according to another embodiment of the present invention.

Referring to FIG. 5B, a circuit diagram of a tri-motor hydraulic system 1200 which drives the spool 100 of the hose reel 1 is shown. A hydraulic pump 1210, such as one provided by tractor 9 via hook-ups 900 (FIG. 4), pushes the hydraulic fluid through the hydraulic manifold 500 to the first tri-motor 1220, the second tri-motor 1230, and the third tri-motor 1240. The directional valve 1250 allows the spool 100 to be turned in either the forward or reverse direction. This tri-motor hydraulic system 1200 is configured to run the motors selectively in one of series, parallel, and free wheel operating modes though the use of first mode valve 1260 and the second mode valve 1270, which together set the operating mode.

While in a series operating mode configuration, the hydraulic fluid is first sent to the first tri-motor 1220, second tri-motor 1230, or the third tri-motor 1240, and then the remaining motors. This results in one motor receiving more of the pressure, and increases the speed that the spool 100 turns but lowering the torque in comparison to the parallel mode. While in a parallel operating mode configuration, the hydraulic fluid is sent to all three of the motors equally, resulting in an increase in torque and decrease in speed of the system in comparison to the series configuration. With three motors in parallel, the torque is tripled from that of one motor, and the speed is reduced to a third. While in the free wheel operating mode configuration, no hydraulic fluid is forced through the motors, however they are free to turn. This allows the spool 100 to turn freely with only the resistance provided by the transmission assembly 300, the motors, the weight of the spool 100, and other nominal factors to prevent the spool 100 from turning. This resistance is expected to be about 40 pounds of pressure, but may be up to about 80 pounds and down to about 20 pounds, depending on the operating mode configuration of the hose reel 1. The optional flow restrictor 1280 is capable of limiting the flow of hydraulic fluid to the motors, allowing for adjustment of the turning resistance of the spool 100 during the free wheel operating mode configuration. Altering the resistance through the flow restrictor 1280 may be useful for increasing and decreasing the rate that a hose deploys from the hose reel 1. It is contemplated the flow restrictor 1280 may be fixed or adjustable. Additionally, the system relief valve 1290 protects the system from excess pressure.

In most tractors 9 suitable for operating the hose reel 1 of the present invention, the provided hydraulic pressure provided by the pump is about 2900 PSI, or from about 1900 PSI to about 3900 PSI. Also, most motors suitable for operating the hose reel 1 are capable of handling at least about 2500 PSI of hydraulic pressure. Therefore, if the pump of the tractor 9 does produces more than 2500 PSI, more than one motor may be required to operate the hose reel 1 reliably. It is contemplated that some embodiments may have more than three motors, and other hydraulic systems not described in the circuit diagrams of FIGS. 5A and 5B are contemplated to operate the hose reel 1. In one or more three motor embodiments, a third motor may not be provided initially, but the system is expandable to incorporate a third motor if desired.

Figure 6:
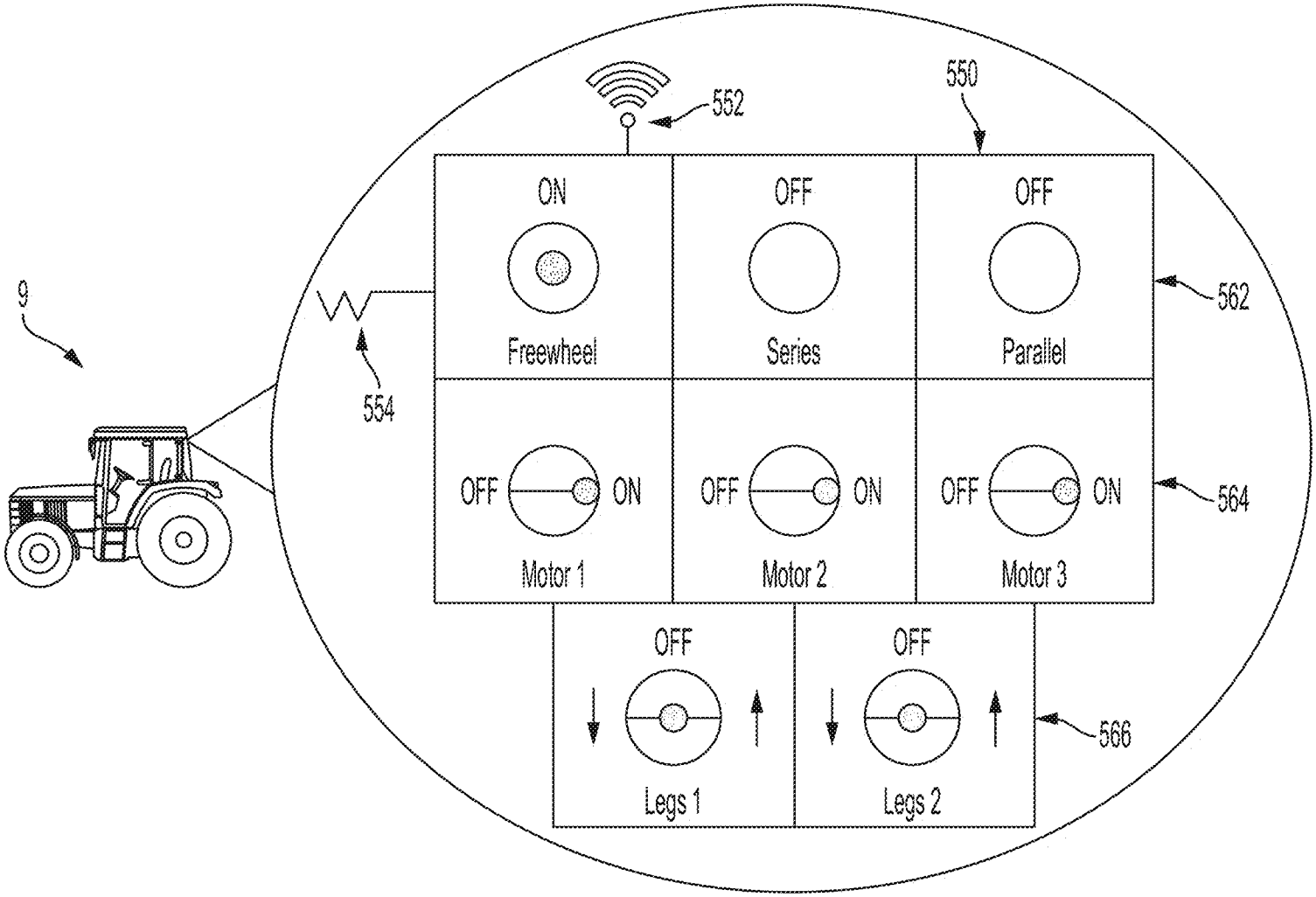
FIG. 6 is a diagram depicting a remote hose reel hydraulic manifold controller according to one or more embodiments of the present invention.

As mentioned above, the hydraulic manifold 500 routes the hydraulic fluid from the pump to the hydraulic motors of the hose reel 1. The manifold 500 is also operable to set the system selectively to a series, parallel, or free wheel operating mode. Additionally, the manifold 500 is capable of removing hydraulic pressure from one or more motors. Optionally, the manifold may be configured to actuate the support assembly 600 and/or other auxiliary hose reel systems. In one embodiment, the hydraulic manifold 500 may be manually operated by hand. However, this may be less than optimal in some cases, such as when the manifold 500 must be actuated many times in succession or only one person is operating the tractor 9 and the hose reel 1, and must exit the tractor 9 to hand operate the manifold 500. In such a case and referring now to FIG. 6, the hose reel 1 may comprise a remote hose reel hydraulic manifold controller 550 that may be located in the cabin of the tractor 9 or at any other suitable place on the tractor in order to provide remote operation of the hydraulic manifold 500. The controller 550 may be connected to the hydraulic manifold 500 through a controller wireless system 552 or through a controller wired system 554. A single person while operating the tractor 9 may as well actuate the hydraulic manifold 500 and set selectively one of the series, parallel, and free wheel operating modes as desired by providing a related command to the controller 550*a* without exiting the tractor 9.

The remote hose reel hydraulic manifold controller 550 is configured to activate one or all of the manifold 500 features. For example, as shown, the controller 550 may comprise several rows of selectable options, such as a Mode control row 562, a motor control row 564, and a leg control row 566. The mode control row may contain selections for the various operating mode configurations: a free wheel operating mode, series operating mode, and parallel operating mode, which would be selectable one at a time. The motor control row 564 may contain a selection to turn on or off one or more of the motors. The leg control row 566 would allow the retractable and extendable support system to be activated.

Figure 7:
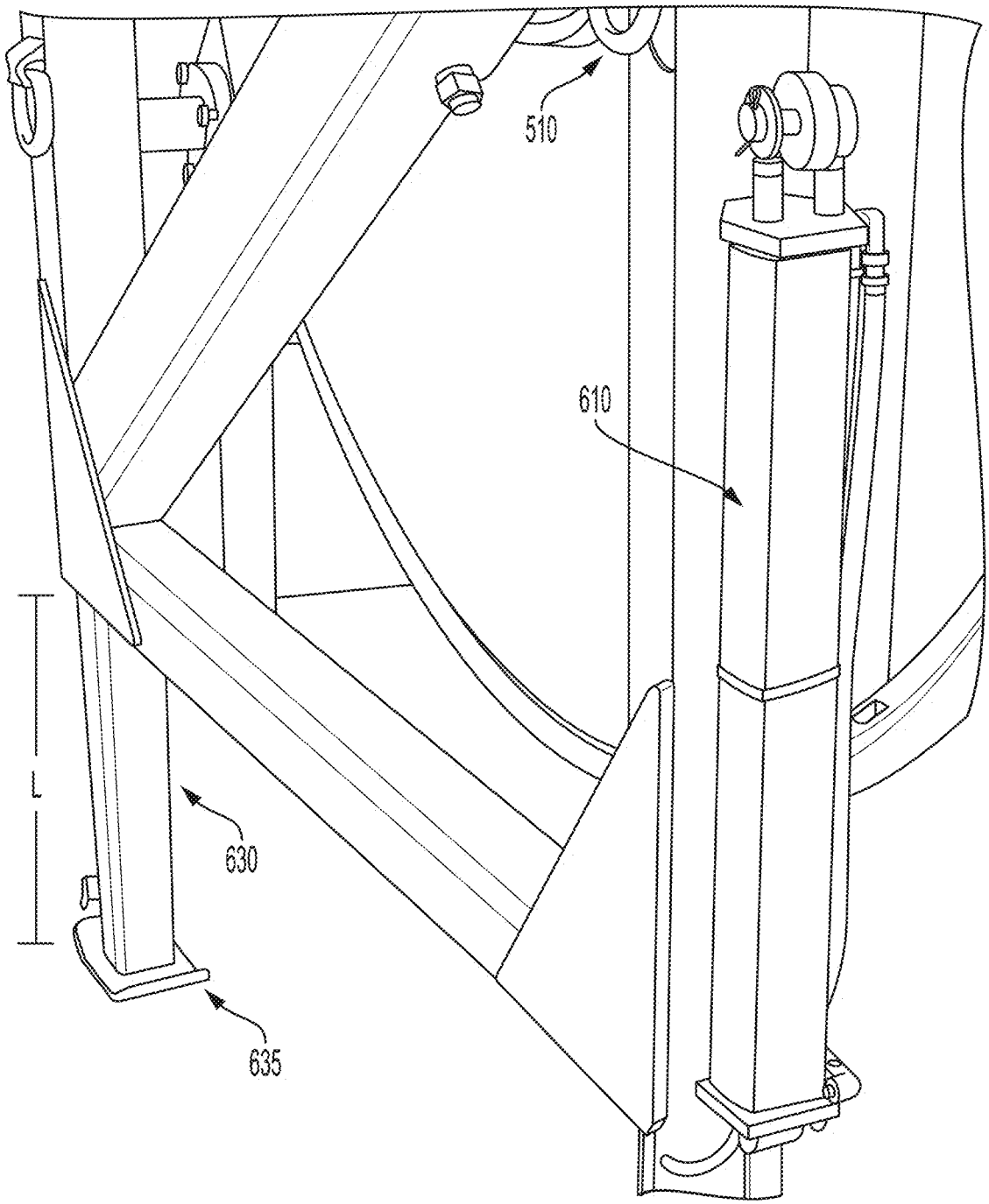
FIG. 7 is a perspective view depicting the hydraulic leg system according to one or more embodiments of the present invention.

Referring now to FIGS. 1 and 7, the hose reel 1 may comprise a support assembly 600 to allow for improved transportation, loading, and unloading. The support assembly 600 may comprise one or more hydraulic pistons 610 located on the frame 200 of the hose reel 1. It is contemplated that two hydraulic pistons 610 may be located on the frame 200 at the front end 2 and the back end 4 of the hose reel 1. Optionally, a hydraulic piston 610 may be located at each corner of the frame 200. Each hydraulic piston 610 is connected to at least one support leg 630, which is raised and lowered by the hydraulic piston 610. In addition, each hydraulic piston 610 is supplied with hydraulic pressure, e.g. from the hydraulic piston hose 510 (FIG. 4) via hook-ups 900 of the tractor 9 by a controlled operation.

Optionally, each hydraulic piston 610 may be actuated independently, or may operate concurrently with one or more other hydraulic piston 610. For example, the two hydraulic pistons 610 located on the front end 2 of the hose reel 1 may be configured to extend and retract together, and the two hydraulic pistons 610 located on the back end 4 of the hose reel 1 may be configured to extend and retract together. All or some of the support legs 630 may have a support leg base 635 fixed to the portion of the support leg 630 that would contact the ground or loading surface. The support base 635 may be a substantially flat plate to provide support for the hose reel 1, or wheels to allow for easier transportation. The hydraulic piston 610 is capable of retracting and extending the support leg 630 up to a length L wherein the support leg 630 is fully extended. The length L shown is for illustrative purposes only and is dependent on the length L desired for the application and therefore may increase or decrease from the present distance. It is expected that the hydraulic piston 610 will raise and lower the support legs 630 whether the support leg base 635 is suspended or on a surface.

Referring now to FIGS. 8A-8D, the loading of the hose reel 1 from a mounted position on a tractor 9 to a tow trailer 10 is shown. In one embodiment, the hose reel 1 may be a pull-type hose reel mounted on the front of the tractor 9 or a payloader, and may utilize a quick hitch mounting system. Other embodiments may include a pull type hose reel or a truck type hose reel. As the size of agricultural production and other industries grow, it is of increasing importance that hose reel systems are capable of being transported, mounted, and dismounted efficiently. Additionally, it is often difficult to load a hose reel 1 on a tow trailer 10 because tow trailer load heights, approximately 24 inches to 36 inches, are usually substantially higher than the ground clearance of an unloaded hose reel 1, approximately 6 inches to 12 inches.

Figure 8A:
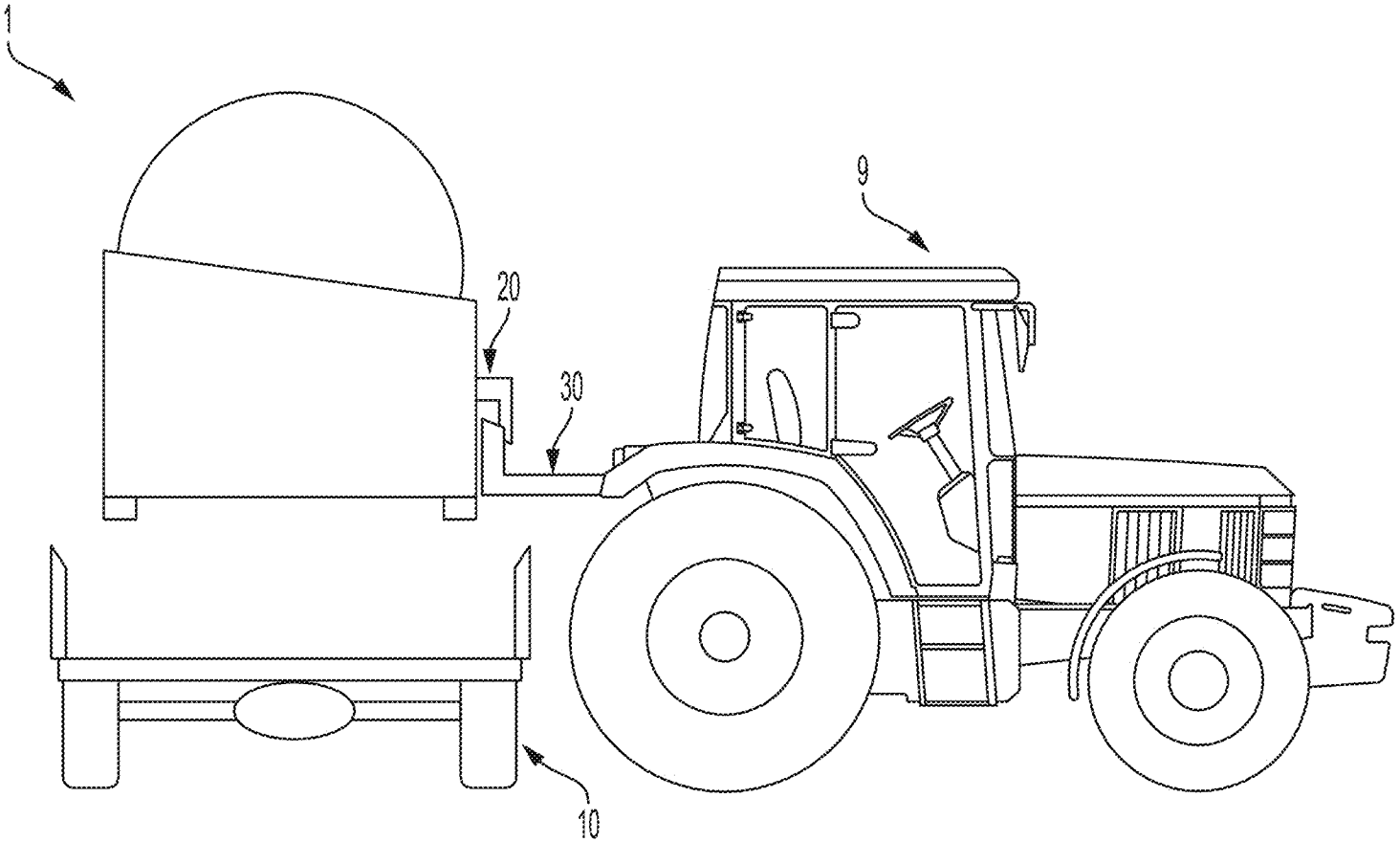
FIGS. 8A-8D are side views depicting a method of unloading the hose reel from according to one or more embodiments of the present invention.
Figure 8B:
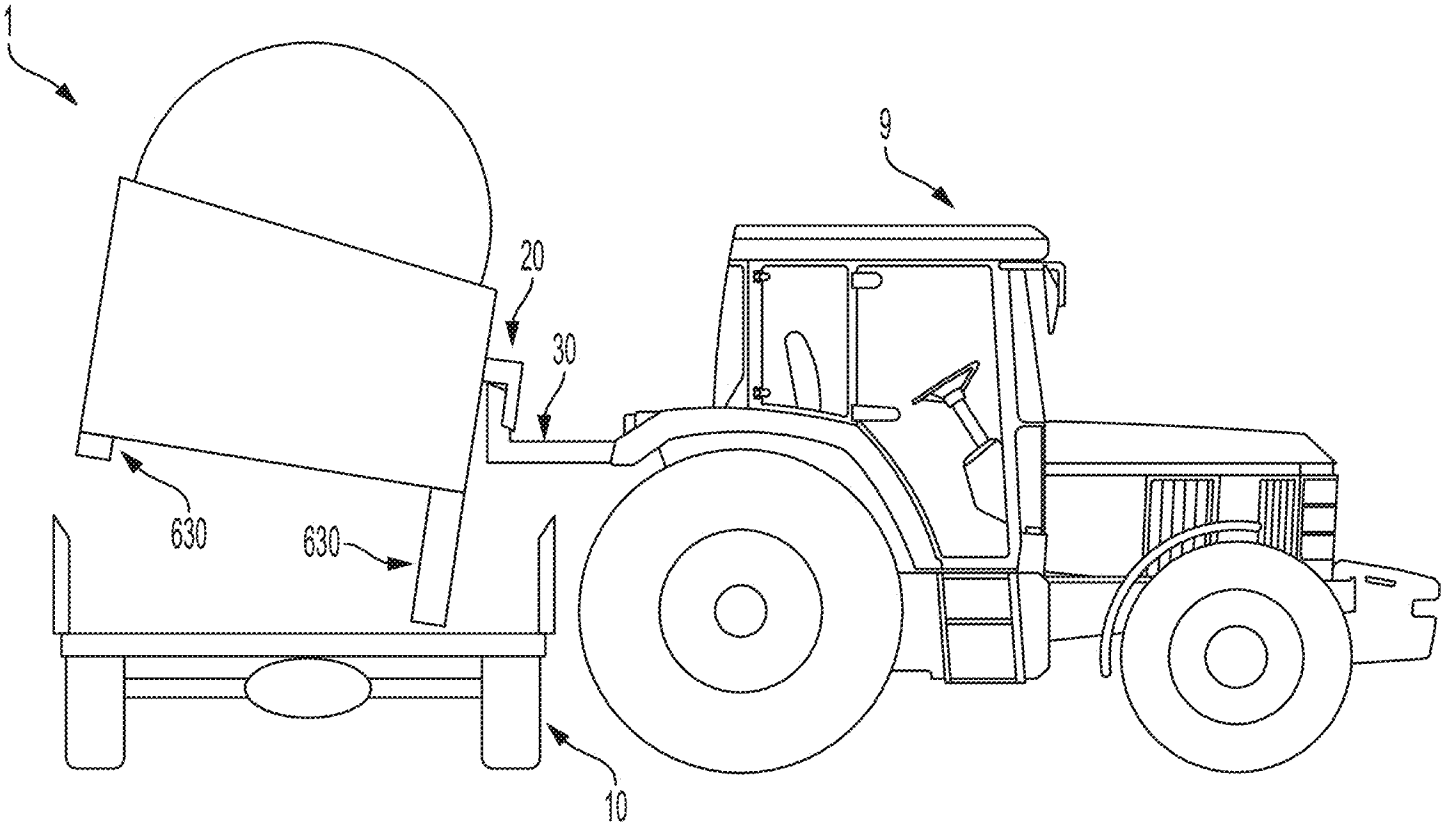
Figure 8C:
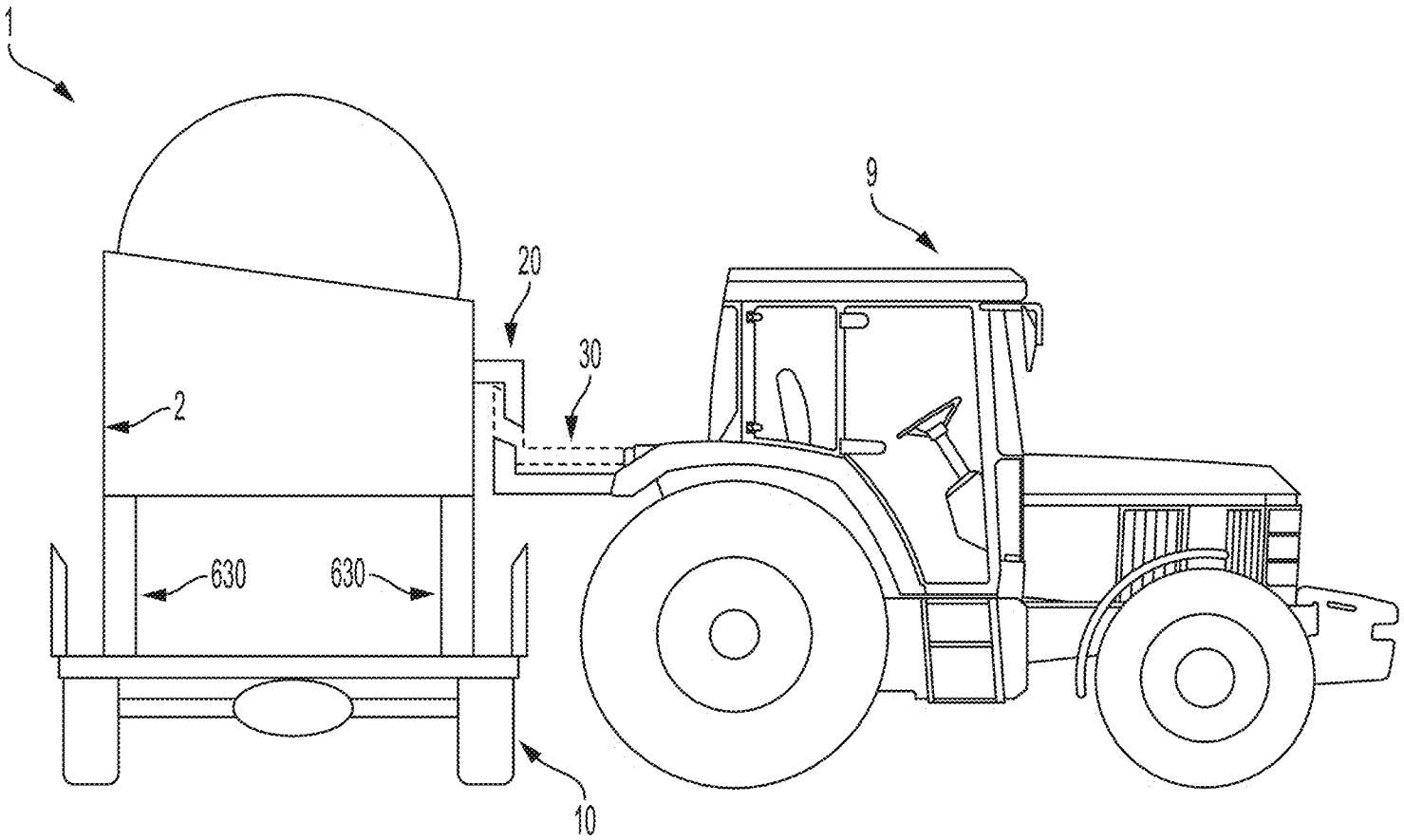
Figure 8D:
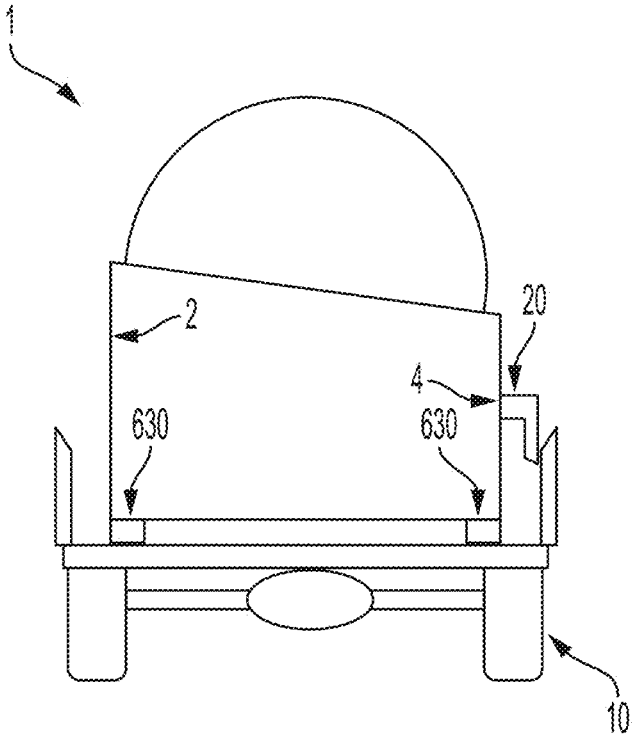

FIG. 8A shows the hose reel 1 mounted to the tractor 9 by the hose reel hitch 20 and the tractor hitch 30. The tow trailer 10 is capable of being placed under the hose reel 10 in this position. FIG. 8B shows the hydraulically operated support legs 630 located on the back end 4 in a lowered position, able to partially support the hose reel 1 on the tow trailer 10. In this position, the pressure on the hitches caused by the hose reel weight can be removed from between the hose reel hitch 20 and the tractor hitch 30, and any connecting pins or other securing means can be released. Additionally, this puts the hose reel 1 at a substantial enough angle to allow the hose reel hitch 20 to disengage from the tractor hitch 30. FIG. 8C shows the support legs 630 on the front end 2 and the back end 4 of the hose reel 1 in a partially lowered state, able to support the hose reel 1 fully. The tractor hitch 30 can be moved out of the path of the hose reel hitch 20. FIG. 8D shows the hose reel 1 fully loaded on the tow trailer 10 and disengaged from the tractor 9. The support legs 630 on the front end 2 and the back end 4 can be fully retracted so the hose reel 1 can be secured to the tow trailer 9. In one embodiment, three hose reels 1 can be placed together on one tow trailer 10. It is contemplated that the hose reel 1 can be unloaded and mounted to a tractor 9 by performing the above operation in reverse order. Instead of a tow trailer 10, the hose reel 1 may also be unloaded and loaded from a truck bed or a platform. It is further contemplated that the hose reel 1 can be unloaded to the ground by following the above operation.

Figure 9:
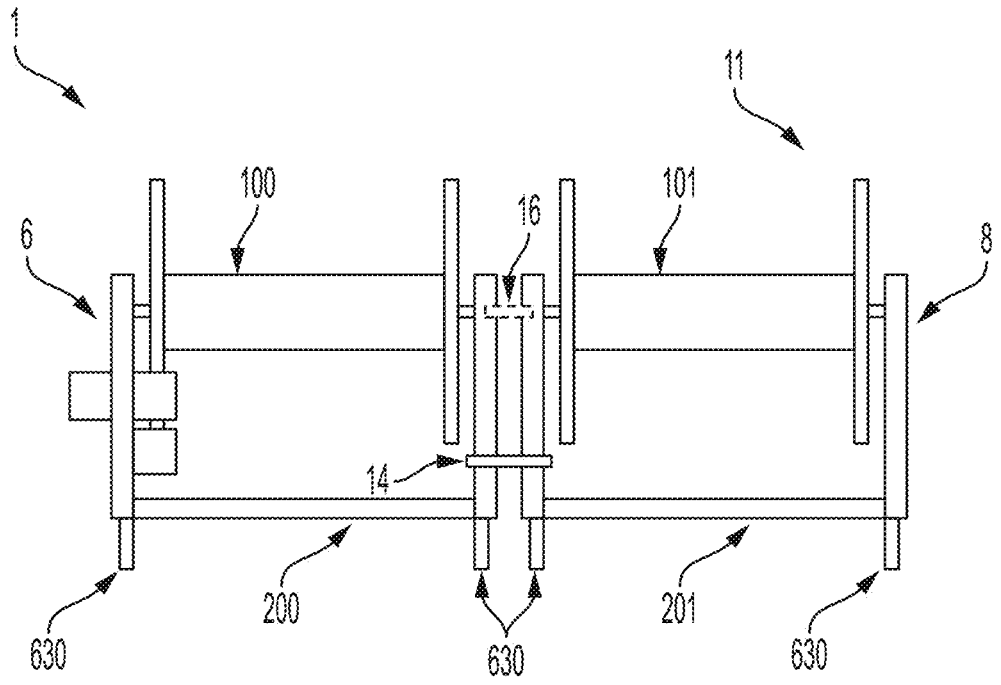
FIG. 9 is a back end view of the hose reel with an attached modular hose reel according to one or more embodiments of the present invention.

Referring to FIG. 9, a modular hose reel 11 mounted to the hose reel 1 by a modular frame bracket 14 and a modular spool drive 16 is shown. The frame bracket 14 removably couples the frame 200 of the hose reel 1 to the modular frame 201. Likewise, the modular spool drive 16 couples releasably via a pin and bolt connection (not shown) to the hose reel spool 100 of the hose reel 1 to the modular spool 101, while causing the modular spool 101 to turn with the hose reel spool 100. In another embodiment, the modular spool drive 16 may optionally cause the modular spool 101 to turn with or instead of the hose reel spool 100, and may be coupled directly to the transmission assembly 300, the hydraulic motor system 400, or the hydraulic manifold 500. In order to increase the amount of hose that can be laid or reeled at one time without replacing the hose reel 1 mounted on a tractor 9 or putting additional hoses on a spool 100, it is contemplated that one or more modular hose reels 11 could be attached to a hose reel 1 already mounted on a tractor 9, effectively multiplying the amount of hose that can be laid or reeled in a single pass. The modular hose reel 11 may optionally have one or more of the hydraulic transmission assembly 300, hydraulic motor system 400, hydraulic manifold 500, and support assembly 600.

It is contemplated that modular hose reels 11 may be mounted on the drive side 6, the free side 8, or both of a first hose reel 1. The modular hose reel 11 may also be coupled to one or more of the hydraulic transmission assembly 300, hydraulic motor system 400, and hydraulic manifold 500 of the first hose reel 1. As shown, the hydraulically operated support legs 630 of the modular spool 101 may be hydraulically connected to the hydraulic manifold 500 or the support assembly 600 of the hose reel 1. This configuration is also effective for transporting the hose reels 1 more efficiently, allowing more hose reels 1 to be placed on a tow trailer 10, and in less time.

It is further contemplated that the hose reel 1 could be combined with a turntable system or pivoting means as described in U.S. Pat. No. 7,530,521, entitled "Hose reel system," which has been fully incorporated herein in its entirety by reference. The turntable system is contemplated to allow at least a portion of the hose reel 1 to pivot up to about 90 degrees. This would allow for more flexibility in loading and transporting the hose reel 1 on a tow trailer 11.

It is further noted that terms like "preferably," "generally", "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

What is claimed is:

1. A hydraulically driven agricultural hose reel comprising:

a front end, a back end, a drive side, and a free side;

a spool journaled to a frame, the spool configured to deploy and retrieve a hose; and a transmission assembly mounted to the frame, the transmission assembly is configured to rotate the spool via a hydraulic motor system hydraulically powered through a hydraulic manifold, wherein the hydraulic motor system comprises two or more motors located on the drive side of the hose reel and includes series, parallel, and free wheel operating modes, and the hydraulic manifold is configured to selectively set the hydraulic motor system between the series, parallel, and free wheel operating modes, wherein the series operating mode hydraulically drives the motors in series, the parallel operating mode hydraulically drives the motors in parallel, and the free wheel mode permits the motors to turn freely.

2. The hose reel of claim 1, wherein the transmission assembly comprises a spool drive means, a spool sprocket, and one or more drive sprockets.

3. The hose reel of claim 2, wherein the transmission assembly comprises a tensioner configured to restrict the travel of the spool drive means, wherein the tensioner is mounted to the frame.

4. The hose reel of claim 2, wherein the spool drive means is a drive chain, drive belt, or driveshaft.

5. The hose reel of claim 1, wherein the hydraulic motor system further comprises three motors.

6. The hose reel of claim 1, wherein the hydraulic manifold further comprises a remote hose reel drive controller.

7. The hose reel of claim 1, wherein each of the two or more motors is coupled to the transmission assembly by a driveshaft, and wherein the driveshaft is coupled to one or more drive sprockets.

8. The hose reel of claim 1, wherein the hose reel is mounted to a tractor.

9. The hose reel of claim 1, wherein the hose reel is configured to rotate selectively at a first speed, a second speed which is faster than the first speed, and a third speed which is faster than the second speed.

10. The hose reel of claim 1, further comprising a support assembly to extend and retract one or more support legs.

11. The hose reel of claim 10, wherein the support assembly further comprises one or more hydraulic pistons located on the frame of the hose reel and connected to the one or more support legs, the one or more hydraulic pistons are configured to raise and lower the one or more support legs.

12. The hose reel of claim 11, wherein each of the one or more hydraulic pistons are configured to be actuated independently or concurrently with another one or more hydraulic pistons.

13. The hose reel of claim 10, wherein one or more support legs comprise a support leg base fixed to the support leg to contact the ground or loading surface.

14. The hose reel of claim 1, wherein a modular hose reel is removably mounted to the hose reel by a modular frame bracket and a modular spool drive.

15. The hose reel of claim 14, wherein the modular hose reel is mounted on the drive side or the free side of the hose reel.

16. A method of loading the hose reel of claim 1 from a tractor to a loading surface, comprising:

positioning the hose reel mounted to the tractor by a hose reel hitch and a tractor hitch above the loading surface;

lowering one or more hydraulically operated support legs located on the back end of the hose reel, configured to partially support the hose reel on the loading surface;

removing pressure from the hose reel hitch and the tractor hitch caused by the hose reel weight and releasing the hose reel from the tractor, wherein the hose reel is at an angle which allows the hose reel hitch to disengage from the tractor hitch;

partially lowering one or more hydraulically operated support legs on the front end of the hose reel, wherein the one or more hydraulically operated support legs on the front end and the rear end fully support the hose reel; and moving the tractor hitch out of the path of the hose reel hitch.

17. A method of unloading the hose reel of claim 1 from the loading surface comprising performing the method of claim 16 in reverse order with reversed actions.

18. The hose reel of claim 1, wherein the hose reel is selectable to rotate at either a first speed or a second speed which is faster than the first speed.

* * * * *